US006416026B1

(12) United States Patent
Porraro

(10) Patent No.: US 6,416,026 B1
(45) Date of Patent: Jul. 9, 2002

(54) DEVICE FOR SUSPENDING OBJECT SUCH AS FRUIT

(76) Inventor: Richard Porraro, 14423 Hellenic Dr. Apt. L10, Tampa, FL (US) 33613-2817

( * ) Notice: Subject to any disclaimer, the term of this patent is extended or adjusted under 35 U.S.C. 154(b) by 0 days.

(21) Appl. No.: 09/633,691

(22) Filed: Aug. 7, 2000

Related U.S. Application Data

(63) Continuation of application No. 09/228,337, filed on Jan. 11, 1999, now abandoned.

(51) Int. Cl.[7] ..... A47G 29/14

(52) U.S. Cl. ..... 248/317; 248/690; 248/339; 248/315; 248/309.1; 248/693

(58) Field of Search ..... 248/317, 339, 248/340, 341, 309.1, 315, 686, 690, 691, 693, 62

(56) References Cited

U.S. PATENT DOCUMENTS

| | | | | |
|---|---|---|---|---|
| 1,972,505 | A | | 9/1934 | Wilson |
| 3,288,417 | A | | 11/1966 | Wallace |
| 3,484,070 | A | | 12/1969 | Horodko et al. |
| 3,870,267 | A | | 3/1975 | Okle |
| 4,141,529 | A | | 2/1979 | Casutt |
| 4,399,918 | A | * | 8/1983 | Clements ..... 211/113 |
| 4,413,799 | A | * | 11/1983 | Gabriel ..... 248/59 |
| 5,117,988 | A | * | 6/1992 | Daniels ..... 211/113 |
| D342,357 | S | * | 12/1993 | Balk ..... D32/58 |
| 5,364,053 | A | * | 11/1994 | Rodgers ..... 248/302 |
| 5,507,460 | A | | 4/1996 | Schneider |
| 5,771,790 | A | * | 6/1998 | Barrows ..... 99/476 |
| 5,794,800 | A | * | 8/1998 | Carmo et al. ..... 211/113 |
| 5,803,321 | A | | 9/1998 | Willinger et al. |
| 6,032,907 | A | * | 3/2000 | Santa Cruz et al. ..... 248/60 |
| D431,127 | S | * | 9/2000 | Connor ..... D6/403 |
| 6,135,397 | A | * | 10/2000 | Santa Cruz et al. ..... 248/74.1 |
| 6,164,616 | A | * | 12/2000 | Woods et al. ..... 248/686 |

* cited by examiner

*Primary Examiner*—Anita King
*Assistant Examiner*—Steven M. Marsh
(74) *Attorney, Agent, or Firm*—Saliwanchik, Lloyd & Saliwanchik

(57) ABSTRACT

The subject invention pertains to a device for suspending objects such as fruit. In a specific embodiment, delicate fruit can be suspended from a kitchen fixture such as a cabinet. The device of the subject invention comprises a fixture attachment means, such as a ring for placement over a hook or knob of a cabinet; a fruit attachment means, such as a rigid tube on which bananas, for example, can be placed; and a connection means between the fixture attachment means and the object attachment means, such as a piece of cord or string.

2 Claims, 4 Drawing Sheets

DEVICE FOR SUSPENDING OBJECT SUCH AS FRUIT

CROSS-REFERENCE TO A RELATED APPLICATION

This application is a continuation of application Ser. No. 09/228,337, filed Jan. 11, 1999 now abandoned.

BACKGROUND OF THE INVENTION

There are a variety of food items which have maximum aesthetic and culinary value when they are not bruised, blemished, or otherwise damaged. Examples of such items include bananas, grapes, and other fruits. Some such items are so delicate that virtually any pressure applied to the surface of the food can cause unsitely marks. The delicate nature of such foods creates a challenge for homeowners, restaurant operators, and food vendors to maintain such items in an attractive and useful condition.

Another challenge faced by many kitchen owners is to find adequate space for all the food items and utensils which are necessary, or desired, to prepare meals. Because of such space constraints, countertop space is often at a premium. Also, an uncluttered countertop provides an attractive, orderly appearance which is very important aesthetically and hygienically in the food preparation art. There are many well known devices which are designed to provide space savings and better organization for kitchen areas. Such devices include, for example, hanging baskets in which vegetables and hard fruits can be placed. Unfortunately, baskets and the like do not solve the problem of bruising delicate foods.

Various hanging devices have been designed to reduce the incidence of bruising of fruits. For example, U.S. Pat. No. Des. 290,558 describes a display stand for fruits which comprises a base to be set on a table or countertop, a curved arm that rises from the base to an elevated height, and a hook attached to the elevated end of the arm, from which the fruit are suspended. In addition to being generally unattractive, the drawbacks of this design include its occupancy of valuable counter space, its cumbersome shape and the difficulty of storing it when it is not in use.

The subject invention provides a space saving device which prevents bruising of delicate food items and offers the additional advantages of being economical and versatile.

BRIEF SUMMARY OF THE INVENTION

The subject invention pertains to a unique and advantageous device for suspending fruit or other such objects to maximally preserve the aesthetic and functional characteristics of the suspended objects. In a specific embodiment of the subject invention, the device of the subject invention can be used to suspend bananas or grapes from kitchen fixtures such as cabinets.

The device of the subject invention will typically comprise three distinct portions. One portion is a fixture attachment means by which the device is attached to an appropriate fixture. A second portion is an object attachment means which enables the device to hold the object which will be suspended. The third portion is a means for connecting the fixture attachment means to the object attachment means.

The fixture attachment means may be, for example, a ring for placement around a knob of a cabinet or over a hook placed on the under side of a cabinet. The object attachment means may be, for example, a rigid bar on which fruit can be hung. The connecting means connects the object attachment means to the fixture attachment means and may be, for example, a piece of cord or string.

DETAILED DESCRIPTION OF THE INVENTION

Figure 1:
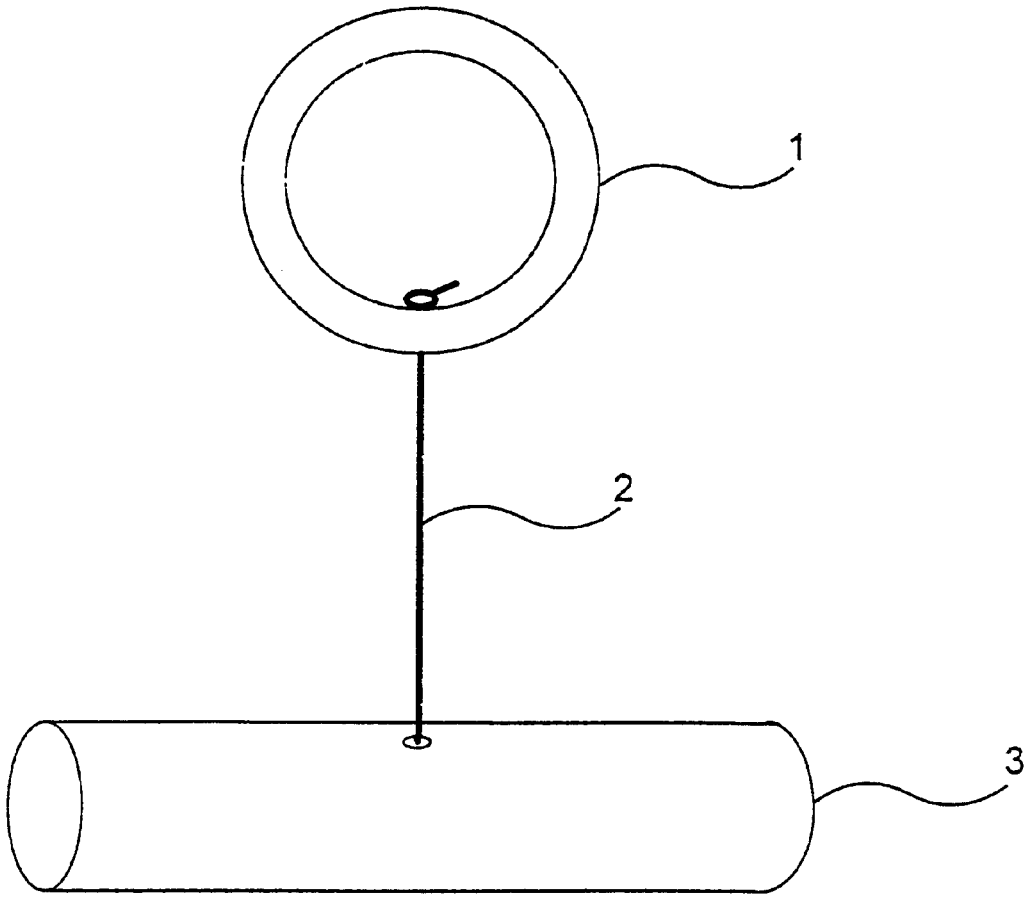
FIG. 1 shows one subject embodiment of the subject invention.
Figure 2:
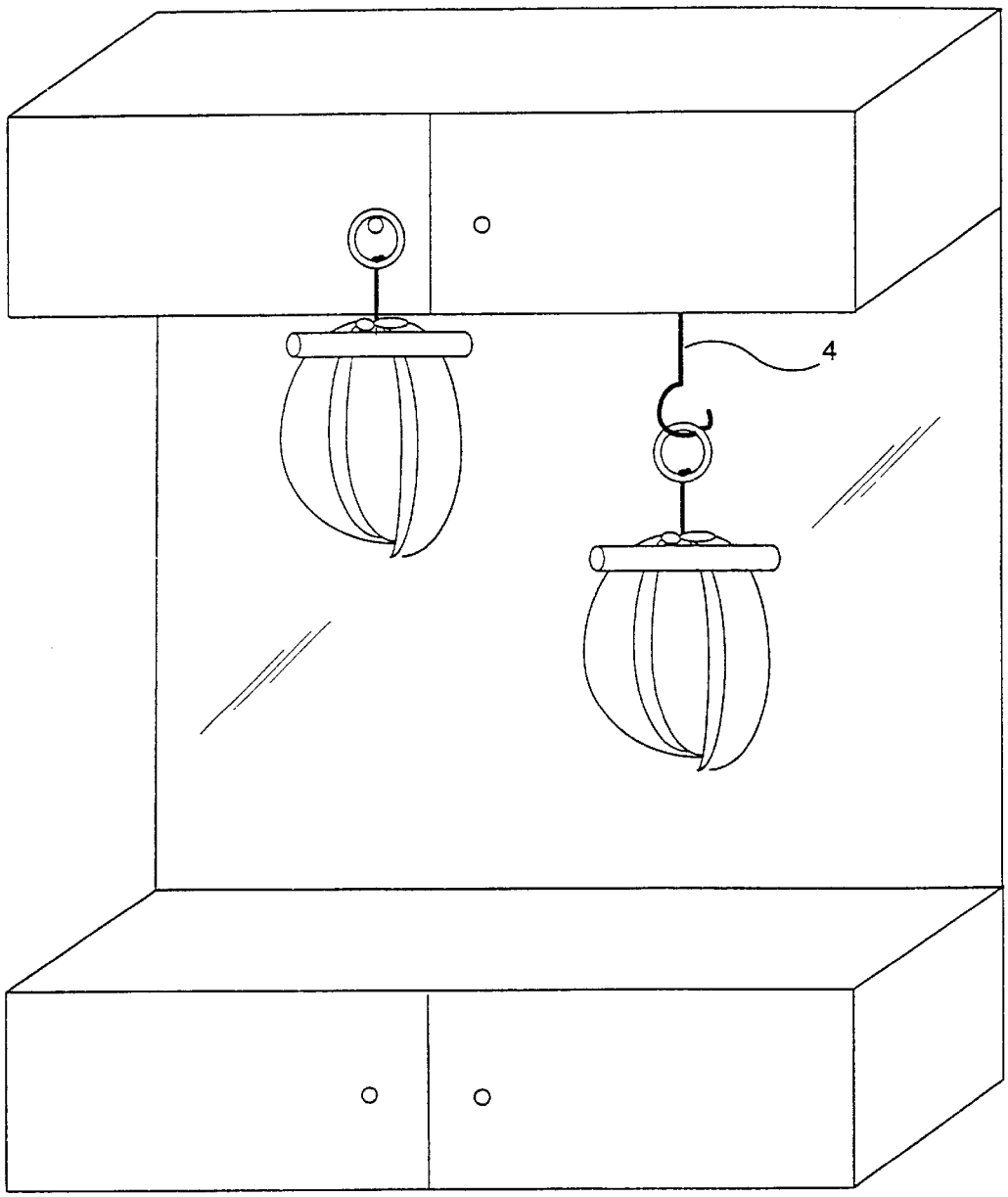
FIG. 2 shows the subject invention in use.
Figure 3:
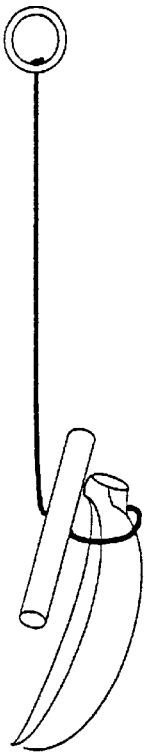
FIG. 3 shows the invention in use with a single banana.

The subject invention pertains to a device for suspending items so as to preserve the functional and/or aesthetic characteristics of the suspended items. In a specific embodiment of the subject invention the device may be used to suspend delicate food items including, for example, bananas, from a kitchen fixture such as a cabinet. One specific embodiment of the object-suspending device of the subject invention is shown in FIG. 1. The use of specific devices of the subject invention is shown in FIGS. 2 and 3.

In a specific embodiment,the device of the subject invention comprises three distinct components. A first component is a means for attaching the device to a fixture from which an object is to be suspended. This component is referred to herein as the fixture attachment means. An example of a fixture attachment means is the ring shown as 1 in FIG. 1.

As used herein, the term "fixture" refers to any structure suitable for suspending an object therefrom. Thus, the fixture may be, for example, a cabinet, shelf, or ceiling. The fixture may already have an appropriate location from which objects may be suspended or the fixture may be modified in order to provide a location to which the device of the subject invention can be attached. For example, knobs or pulls on kitchen cabinets provide a convenient location from which to suspend objects using the device and methods of the subject invention. Alternatively, cabinets may be modified to provide an attachment location. An example of a cabinet modified to provide an attachment location is the hook shown as 4 in FIG. 2. A hook or other such attachment location can be added to a cabinet, shelf, ceiling, or other fixture. If a hook is added to a fixture, it can be added by, for example, use of a suction cup, adhesive, magnet, screw, nail, or any other attachment method. In one specific embodiment a hook is screwed into the underside of a kitchen cabinet thus providing a convenient location from which to hang bananas using the device of the subject invention.

One aspect of the subject invention is a commercial product which comprises the object-suspending device as described herein as well as an item which can be used to modify a fixture in order to provide a location for suspending an object as described herein. The item may be, for example, a hook which can be affixed to a cabinet, shelf, or ceiling, by screw threads, suction, glue or other appropriate means. Preferably the commercial product would provide the attachment item in a single package with the object-suspending device.

As described above, the object-suspending device of the subject invention can be attached to unmodified fixtures by, for example, placing the device over a knob or pull. Alternatively, as discussed above, the fixture can be modified with, for example, a hook to provide a convenient location to attach the object-suspending device. A further aspect of the subject invention is the provision of a variety of fixture attachment means for the object-suspending device. Thus, in addition to a ring which can be used as the fixture attachment means, the fixture attachment means can be, for example, a suction cup, loop of flexible material, hook and loop materials such as VELCRO, screw, nail, thumbtack, adhesive, or any other attachment means.

Figure 6A:
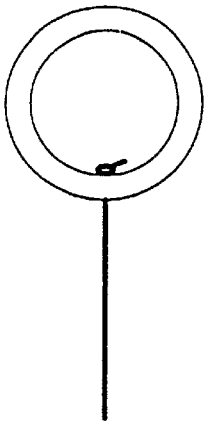
FIGS. 6A–C shows various fixture attachment components.
Figure 6B:
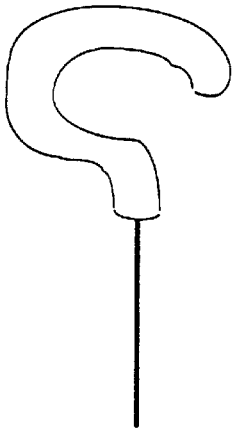
Figure 6C:
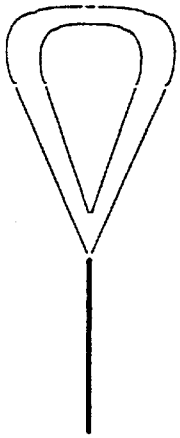

Thus, the fixture attachment means may be attached to a cabinet or other fixture by, for example, placing it over a cabinet knob or other appropriate protrusion. Also, the fixture attachment means may be attached to a hook or other connecting device affixed to the fixture expressly for attachment to the subject invention. The fixture attachment means may be constructed from any solid material, including wood, metal or plastic. It may be rigid or flexible. The fixture attachment means may be made in any of a variety of configurations, examples of which are illustrated in FIGS. 6A–C.

Figure 5A:
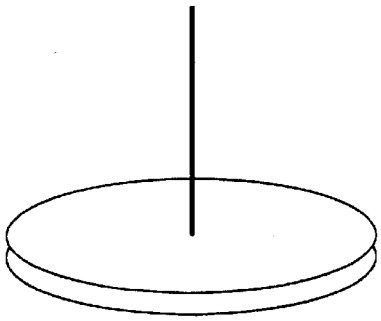
FIG. 5A–B shows various object attachment components.
Figure 5B:
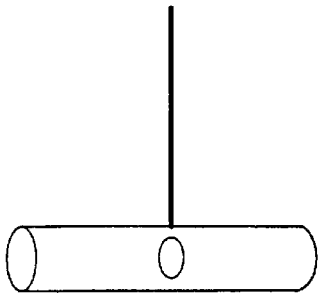

A second distinct component of the device of the subject invention is an object attachment means from which an object may be suspended. The object attachment means is shown as 3 in FIG. 1. The object may be, for example, any type of clumped fruit, but most preferably bananas. The object attachment means may be constructed from any solid material, including wood, metal or plastic. It may also be made in any of a variety of configurations, examples of which are illustrated in FIGS. 5A and 5B.

FIG. 1 shows 2 as the connection means between 1, the fixture attachment means, and 3, the object attachment means. The connection means 2 is preferably constructed of a flexible material for ease of storage and increased usage versatility. Materials from which 2 can be made include, but are not limited to, string, rope, flexible tubing, and cord. If a flexible material is used, the invention can hold a single banana by twisting the connection means around the end of the banana and securing it against the object attachment means, as shown in FIG. 3. In one embodiment of the subject invention, the attachment means is made of a material which is easily cut or otherwise adjustable. This enables the user of the device of the subject invention to custom-fit the device for use in a particular location for a particular purpose. The attachment means may also be composed of rigid materials for aesthetic reasons or to increase durability.

Figure 4:
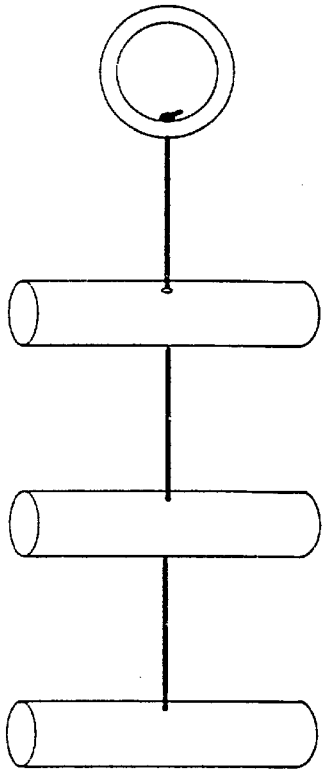
FIG. 4 shows the invention with multiple fruit attachment components.
Figure 7:
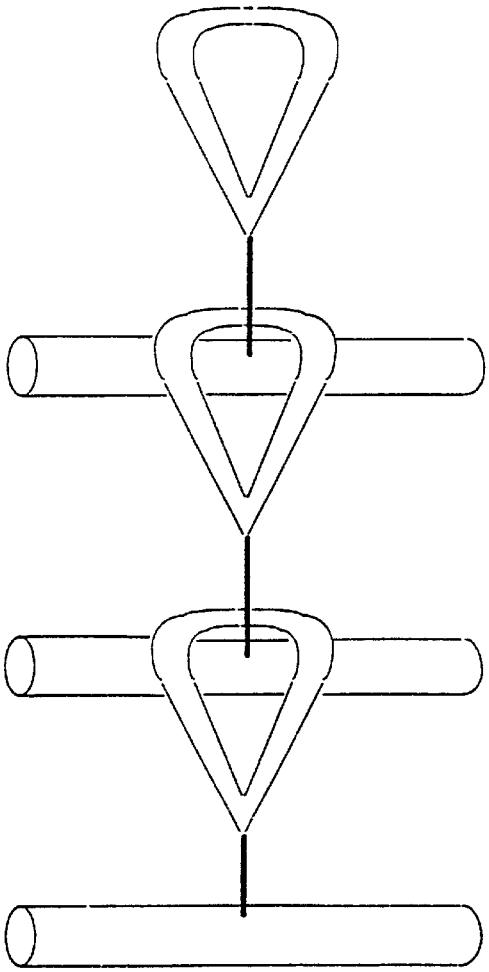
FIG. 7 shows multiple units linked vertically.

In another embodiment, the invention may comprise a series of object attachment means. The invention may either be manufactured with multiple object attachment components, as illustrated in FIG. 4,. or it may be constructed by linking several individual devices together, as shown in FIG. 7. These configurations are useful for hanging a large amount of fruit such as several banana bunches, for effectively using vertical space in a kitchen, for hanging fruit from the ceiling, and for decorative purposes.

The following examples illustrate embodiments of the subject invention. These examples should not be construed as limiting.

Example 1—Construction of a Fruit Hanging Device

In a specific embodiment, illustrated in FIG. 1, the fixture attachment means is a ring that is about 1–½ inches in diameter and comprises a hole drilled through its radial thickness. This ring may be, for example, from about ½ inch to about 3 inches in diameter. In a specific embodiment, the fixture attachment means is made of wood, which is chosen for its light weight and economy. The connection means is a piece of nylon cord which is about 6 inches long. The connection means may be from about 2 inches to about 18 inches long. Nylon is chosen because it is durable, lightweight, easily cut, and economical. The object attachment means is a wooden cylindrical tube that is about ¾ inch in diameter and about 3 inches in length and comprises a hole drilled through its radial thickness. The diameter may be from about ¼ inch to about 2 inches, and the length may be about 1 inch to about 12 inches. One end of the connection means can be threaded through the drilled hole of the fixture attachment means and knotted so that it cannot slip back through. Similarly, the other end of the connection means is threaded through the drilled hole of the object attachment means and knotted so that it cannot slip back through.

Example 2—Use of the Subject Invention

In order to use the fruit hanging device of the subject invention, the fixture attachment means can be placed over a hook which is screwed into the underside of a kitchen cabinet. A bunch of bananas is then suspended from the cabinet by placing the bananas on the object attachment means of the device of the subject invention.

It should be understood that the example and embodiments described herein are for illustrative purposes only and that various modifications or changes in light thereof will be suggested to persons skilled in the art and are to be included within the spirit and purview of this application and the scope of the appended claims.

What is claimed is:

1. A method for suspending bananas, wherein said method comprises the steps of: attaching to a fixture a device for suspending bananas, wherein said device for suspending bananas consists of a single fixture attachment means, a single object attachment means selected from the group consisting of cylindrical tubes and discs, and a single flexible connecting means which couples said figure attachment and said object attachment means, wherein said flexible connecting means is sufficiently flexible so that a single banana can be secured by wrapping said connecting means around a banana and lodging said object attachment means against said connecting means; and wherein said method further comprises hanging one or more bananas from said device.

2. The method for suspending banana, according to claim 1, wherein:

the fixture attachment means is selected from the group consisting of rings, suction cups, loops of flexible material, hooks, screws, thumbtacks, and adhesives; and the connecting means is selected from the group consisting of string, wire, rope, and cord.

* * * * *

UNITED STATES PATENT AND TRADEMARK OFFICE

CERTIFICATE OF CORRECTION

PATENT NO. : 6,416,026 B1
DATED : July 9, 2002
INVENTOR(S) : Richard Porraro

It is certified that error appears in the above-identified patent and that said Letters Patent is hereby corrected as shown below:

Column 4,
Lines 43-44, “figure attachment and said” should read -- fixture attachment means and said --.
Line 51, “banana,” should read -- bananas, --.
Line 55, “screws, thumbtacks,” should read -- screws, nails, thumbtacks, --.

Signed and Sealed this

Twelfth Day of November, 2002

*Attest:*

*Attesting Officer*

JAMES E. ROGAN
*Director of the United States Patent and Trademark Office*